US009337569B2

(12) United States Patent
Kindermann et al.

(10) Patent No.: US 9,337,569 B2
(45) Date of Patent: May 10, 2016

(54) FLUID-TIGHT CONTACT IMPLEMENTATION

(71) Applicant: Kostal Kontakt Systeme GmbH, Luedenscheid (DE)

(72) Inventors: Gerd Kindermann, Dortmund (DE); Uwe Pitzul, Halver (DE); Uwe Raschke, Hagen (DE); Marek Ciezarek, Dortmund (DE)

(73) Assignee: Kostal Kontakt Systeme GmbH, Luedenscheid (DE)

( * ) Notice: Subject to any disclaimer, the term of this patent is extended or adjusted under 35 U.S.C. 154(b) by 111 days.

(21) Appl. No.: 14/279,964

(22) Filed: May 16, 2014

(65) Prior Publication Data

US 2014/0256167 A1 Sep. 11, 2014

Related U.S. Application Data

(63) Continuation-in-part of application No. PCT/EP2012/074973, filed on Dec. 10, 2012.

(30) Foreign Application Priority Data

Dec. 13, 2011 (DE) ..... 10 2011 121 133

(51) Int. Cl.

| | |
|---|---|
| ***H01R 13/405*** | (2006.01) |
| ***H01R 13/52*** | (2006.01) |
| ***H01R 13/41*** | (2006.01) |
| *H01R 43/00* | (2006.01) |

(52) U.S. Cl.

CPC ..... *H01R 13/521* (2013.01); *H01R 13/41* (2013.01); *H01R 43/005* (2013.01)

(58) Field of Classification Search

CPC ..... H01R 13/52; H01R 43/24; H01R 13/03
USPC ..... 439/106, 606, 886
See application file for complete search history.

(56) References Cited

U.S. PATENT DOCUMENTS

| | | | | |
|---|---|---|---|---|
| 3,182,282 A * | 5/1965 | Turner | ..... | H01H 51/282 264/274 |
| 3,522,575 A | 8/1970 | Watson et al. | | |
| 4,029,388 A * | 6/1977 | Knoll | ..... | H01R 13/405 249/96 |
| 4,580,005 A * | 4/1986 | Minks | ..... | H01H 50/023 174/17.07 |

(Continued)

FOREIGN PATENT DOCUMENTS

| | | |
|---|---|---|
| DE | 1765571 A1 | 7/1971 |
| DE | 3809209 A1 | 9/1989 |

(Continued)

OTHER PUBLICATIONS

European Patent Office, International Search Report for the corresponding International Application No. PCT/EP2012/074973 mailed Apr. 8, 2013.

*Primary Examiner* — Hae Moon Hyeon
(74) *Attorney, Agent, or Firm* — Brooks Kushman P.C.

(57) ABSTRACT

A fluid-tight contact implementation includes a plastic body and a flat contact(s). The plastic of the plastic body is composed of a non-shrinking, duroplastic material. The flat contact has a region encapsulated by the plastic body. The encapsulated region of the flat contact has a cross-sectional width which varies along an axial direction of the flat contact. Longitudinal edges of the encapsulated region of the flat contact along the axial direction are rounded.

19 Claims, 2 Drawing Sheets

(56) References Cited

U.S. PATENT DOCUMENTS 4,733,206 A * 3/1988 Dirmeyer ..... H03H 1/0007 333/167
5,122,075 A * 6/1992 Kile ..... H01R 9/091 439/329
5,387,119 A * 2/1995 Wood ..... H01R 13/523 439/281
5,470,248 A * 11/1995 Wood ..... H01R 13/523 439/271
5,575,666 A * 11/1996 Dent ..... H01R 43/16 439/751
5,624,282 A * 4/1997 Eggers ..... H01R 13/41 439/733.1
6,165,013 A * 12/2000 Broussard ..... H01R 13/523 174/110 SR
6,582,251 B1 * 6/2003 Burke ..... H01R 13/5202 439/589
6,821,162 B2 * 11/2004 Mott ..... H01R 13/04 439/722
6,910,920 B2 * 6/2005 Su ..... H01R 43/24 439/106
6,981,896 B2 * 1/2006 Su ..... H01R 13/652 439/606
7,070,460 B1 * 7/2006 Nagano ..... H01R 43/24 439/736
7,638,721 B2 * 12/2009 Rehbein ..... H01R 4/58 174/126.1
7,645,171 B2 * 1/2010 Mott ..... H01R 13/04 264/255
7,731,531 B2 * 6/2010 Tsujino ..... H01R 4/029 29/858
7,901,247 B2 * 3/2011 Ring ..... H01R 13/405 439/606
8,697,247 B2 * 4/2014 Kaspar ..... H01R 13/03 200/265
8,771,025 B2 * 7/2014 Lee ..... H01R 43/24 439/693
2005/0202720 A1 9/2005 Burke et al.
2006/0148339 A1 * 7/2006 Kaspar ..... H01R 13/03 439/886
2016/0020550 A1 * 1/2016 Pitzul ..... H01R 13/521 439/587

FOREIGN PATENT DOCUMENTS

DE 9101786 U1 5/1991
DE 102005022670 A1 11/2006
DE 102009058525 A1 6/2011
GB 2005929 A 4/1979

* cited by examiner

FLUID-TIGHT CONTACT IMPLEMENTATION

CROSS-REFERENCE TO RELATED APPLICATIONS

This application is a continuation-in-part of International Application No. PCT/EP2012/074973, published in German, with an International filing date of Dec. 10, 2012, which claims priority to DE 10 2011 121 133.4, filed Dec. 13, 2011; the disclosures of which are hereby incorporated in their entirety by reference herein.

TECHNICAL FIELD

The present invention relates to a fluid-tight contact implementation (i.e., a fluid-tight via) having a plastic body and a flat contact(s) in which the plastic body encapsulates a portion of the flat contact and the encapsulated portion of the flat contact has one or more cross-section changes.

BACKGROUND

DE 10 2009 058 525 A1 describes a fluid-tight contact implementation having a flat contact(s). A section(s) of the flat contact has a cross-sectional contour tapered circumferentially in the axial direction. Following an extrusion coating of a plastic material onto the section of the flat contact, the flat contact is displaced in the direction of its tapering(s) against the extrusion coating. This displacement causes cavities of the sections of the flat contact to be closed along the outer surfaces of the tapered contour. The contact implementation is thereby sealed axially along the section of the flat contact.

The sealing of the cavities during the displacement of the flat contact arises from contraction of the plastic material during cooling. Thermoplastic materials, in particular, change their internal structure during cooling which causes a reduction in the material volume. This after shrinkage leads to a small gap(s) in the flat contact which is sealed in the manner described. The attainable degree of sealing is often not sufficient under adverse environmental conditions such as high pressures and temperatures.

Challenging environmental conditions are encountered by connector parts built into vehicle transmission housings. Such connector parts are exposed to changing and high temperature differences and have to withstand vibrations and high oil pressures. In such applications, plug-in connectors with rounded pins are typically used. The round pins are inserted under high pressure into through-holes of a corresponding part. The through-holes have slightly smaller dimensions compared to the cross-sectional dimensions of the round pins.

Such a procedure is problematic when used with flat contacts instead of round pins. This is because pressure forces inside a through-hole do not act symmetrically over the surface of a flat contact. The seal in the region of the long edges of the flat contact is especially difficult to produce since the direction of the normal to the surface changes discontinuously. As a result, adequate oil tightness has not yet been achieved for transmission housing pin connectors with flat contacts for the typically encountered temperature and pressure ranges.

SUMMARY

An object of the invention is to produce a conventional plug-in connector having flat contacts in which the connector is fluid-tight and vibration and chemically resistant at high temperatures and over a large temperature region.

In carrying out at least one of the above and other objects, the present invention provides a fluid-tight contact implementation having a plastic body and a flat contact(s). The plastic of the plastic body is composed of a non-shrinking, duroplastic material. The flat contact has a region encapsulated by the plastic body. The encapsulated region of the flat contact has a cross-sectional width which varies along an axial direction of the flat contact. Longitudinal edges of the encapsulated region of the flat contact along the axial direction are rounded.

Embodiments of the present invention are directed to a fluid-tight contact implementation (i.e., a fluid-tight via) through a plastic body that includes flat contacts. Intermediate regions of the flat contacts have one or more cross-sectional changes in the form or recesses or cavities. The plastic body encapsulates the intermediate regions of the flat contacts. The plastic of the plastic body is a non-shrinking, duroplast material. The longitudinal edges of the flat contacts are rounded. In this manner, the flat contacts can be used in a fluid-tight manner in high-pressure, high-temperature environments.

Embodiments of the present invention include a combination of features of the plastic body being made from a non-shrinking, duroplastic material and longitudinal edges of the flat contacts being rounded. The duroplast material of the plastic body forms an extrusion coating on the flat contacts with intermediate regions of the flat contacts being encapsulated by the plastic body. As such, a fluid-tight contact implementation in accordance with embodiments of the present invention includes the combination of a specifically selected extrusion material for the plastic body and a specific shape of the flat contacts. Both features taken together enable the formation of a contact implementation (i.e., a contact via) that is fluid-tight and can be gas-tight over a defined pressure region.

As described, a duroplastic material is used for the extrusion coating applied onto the flat contacts. In comparison with conventional thermoplastics used for injection molding, duroplastic materials which do not experience a reduction in volume while curing, but remain unchanged or even expand can be used. For the problem to be solved here, non-shrinking, duroplastic materials, also known as "non-shrinkers," which neither shrink nor expand are especially well suited. Such materials can be found, for example, in the groups of epoxy resins, phenol resins, or the so-called bulk molding compounds (BMC). The use of such a non-shrinking, duroplastic material enables a flat contact to be extruded without the formation of gaps during the curing of the extrusion coating duroplastic material.

In order to assure a uniform connection between the duroplastic material and the flat contacts, the longitudinal edges of the flat contacts are initially rounded prior to the flat contacts being extruded through the duroplastic material to be encapsulated by the duroplastic material. This is achieved by embossing the raw longitudinal edges of the flat contacts using a stamping process and thereby rounding the edges circumferentially. The flat contacts thus do not exhibit a precisely rectangular cross-sectional shape, but rather a rectangular cross-section with rounded transitions between the sides of the cross-section.

Each flat contact also has one or more rectangular-shaped or rounded cavities or recesses on edge sections of the extrusion coated region of the flat contact. The cross-sectional widths of the flat contacts thus vary in the axial direction of the flat contacts.

The cavities or recesses of a flat contact cause the flat contact to bond to the extrusion coating material after the flat contact is extruded in a form fitting manner. The cavities or recesses form a labyrinth structure in the axial direction of the flat contact. The labyrinth structure gives rise to a multi-stage pressure drop around the bordering material, whereby the sealing properties of the contact via are further improved. A contributing feature of the extrusion coating material is that its material volume does not change during processing. The extrusion coating thereby tightly fills the cavities or recesses of the flat contact.

In an embodiment of the present invention, the flat contacts and the extrusion coating material are as similar as possible in terms of characteristics. For instance, the flat contacts and the extrusion coating material have at least similar temperature expansion coefficients. In this way, mechanical stresses and gap formation, which diminish the sealing properties, are prevented over a broad temperature range.

In an embodiment of the present invention, a bonding agent is applied to improve the material bonding between the flat contacts and the plastic body formed by the extrusion coating.

In embodiments of the present invention, the two end sections of a flat contact(s) are exposed and are not encapsulated by the plastic body. As such, the end sections of the flat contact do not have thereon the extrusion coating material which forms the plastic body. The remaining portion or segment of the flat contact between the end sections of the flat contact is encapsulated by the plastic body. Thereby, this remaining intermediate region of the flat contact does have thereon the extrusion coating material which forms the plastic body.

In an embodiment, the non-encapsulated end sections of the flat contact(s) are treated by a galvanic process without affecting the extrusion coated intermediate region of the flat contact. This enables favorable sealing properties and high temperature tolerance. In this way, the extrusion coated intermediate region and the non-extrusion coated end sections of the flat contact have different galvanic coatings. Such differences between the intermediate region and the end sections of the flat contact are especially beneficial. Thus, for example, it can be advantageously provided that only the non-extrusion coated end sections of the flat contact have a tin or silver coating.

For this purpose, the flat contacts which are not surface treated, and possibly those treated with an anti-tarnishing material, can be extruded initially during the production sequence. Subsequently, the flat contacts projecting out from the ends of the plastic body are surface treated and possibly passivated. Treating only the end sections of the flat contacts achieves the additional benefit of reducing the use of silver and the passivation agent.

The above features, and other features and advantages of the present invention are readily apparent from the following detailed description thereof when taken in connection with the accompanying drawings.

DETAILED DESCRIPTION

Detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
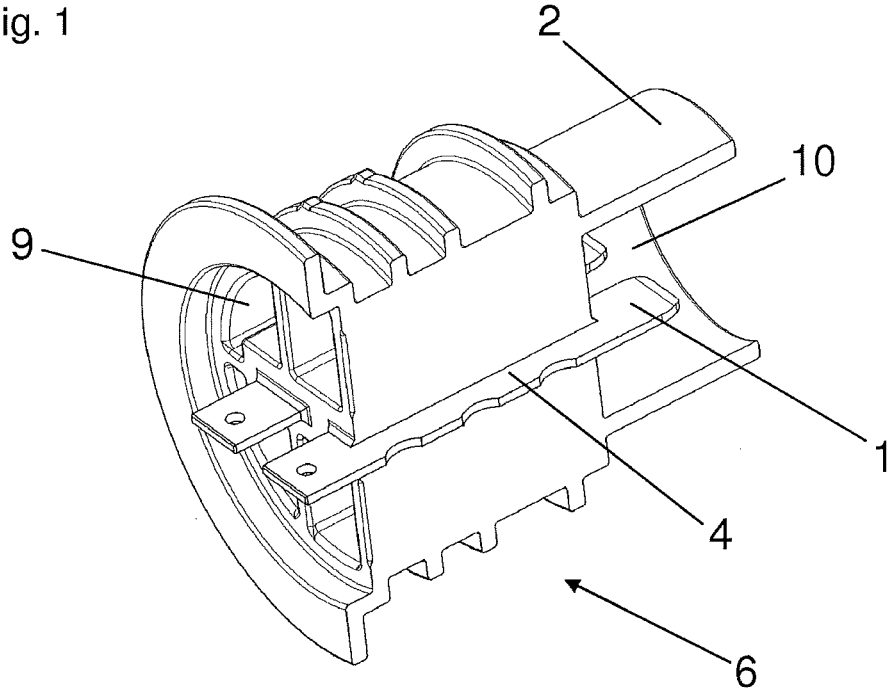
FIG. 1 illustrates a section view of a fluid-tight contact implementation having a plastic body and a plurality of flat contacts in accordance with an embodiment of the present invention.

Referring now to FIG. 1, a fluid-tight contact implementation (i.e., a fluid-tight via) in accordance with an embodiment of the present invention is shown. The contact implementation is in the form of a plug-in connector 6. Connector 6 includes a plastic body 2 and flat contacts 1. Connector 6 has a fluid-tight feed-through of flat contacts 1 between opposite end chambers 9 and 10. In this regard, plastic body 2 encapsulates intermediate regions 4 of flat contacts 1. As shown in FIG. 1, the end sections of flat contacts are not encapsulated by plastic body 2.

Connector 6 is fabricated as an injection molded part. Intermediate regions 4 of flat contacts 1 are extruded with the plastic material forming plastic body 2 to be encapsulated by plastic body 2 during the fabrication process and thereby form connector 6. The plastic material forming plastic body 2 is a non-shrinking, duroplast material.

Figure 2:
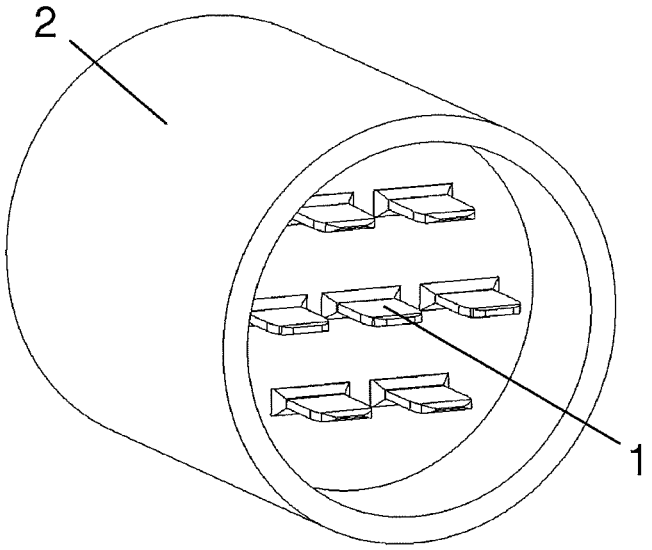
FIG. 2 illustrates a perspective view of a fluid-tight contact implementation having a different amount of multiple flat contacts in accordance with an embodiment of the present invention.

Connector 6 shown in FIG. 1 is an example of a two-pole, fluid-tight contact implementation. This is because connector 6 has two flat contacts 1. A fluid-tight contact implementation in accordance with embodiments of the present invention may have a freely selectable amount of flat contacts 1 including one or more flat contacts 1. For example, FIG. 2 illustrates a fluid-tight contact implementation having seven flat contacts 1. These flat contacts 1 are arranged in three parallel rows with respect to one another.

Figure 3:
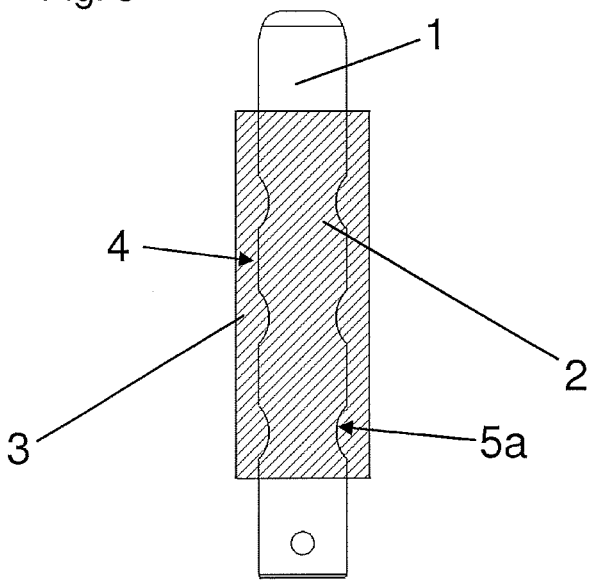
FIG. 3 illustrates a planar view of a flat contact having an extrusion coated intermediate region and non-extrusion coated end sections with the intermediate region having rounded recesses or cavities in accordance with an embodiment of the present invention.

Referring now to FIG. 3, with continual reference to FIGS. 1 and 2, a planar view of a flat contact 1 in accordance with an embodiment of the present invention is shown. Flat contact 1 (or flat pin) includes an intermediate region 4 and end sections at respective ends of intermediate region 4. Intermediate region 4 is coated with an extrusion coating 3 of plastic material forming plastic body 2. Again, the plastic material forming plastic body 2 is a non-shrinking, duroplast material. As such, extrusion coating 3 is a non-shrinking, duroplast coating. The hatched area schematically shows extrusion coating 3 for a partial volume of plastic body 2 that directly encloses intermediate region 4 of flat contact 1. As a result, intermediate region 4 is an extrusion coated (or encapsulated) intermediate region of flat contact 1 and the end sections are non-extrusion coated (or non-encapsulated) end sections of flat contact 1.

Intermediate region 4 of flat contact 1 includes rounded recesses or cavities ("recesses") 5*a*. Rounded recesses 5*a* are formed in the longitudinal sides of flat contact 1 at various locations along the axial direction (length) of flat contact 1. As such, intermediate region 4 includes a plurality of cross-sectional changes or modifications in the form of rounded recesses 5*a*.

Intermediate region 4 with rounded recesses 5 is encapsulated by extrusion coating 3 of plastic material forming plastic body 2. Thus, rounded recesses 5*a* formed in the longitudinal sides of flat contact 1 are within or inside of extrusion coating 3. Extrusion coating 3 makes a bond in a form fitting manner with recesses 5*a*. The bond is fluid-tight over a broad temperature and pressure region due to the "non-shrinking" properties of the duroplastic material that is used for extrusion coating 3.

Figure 4:
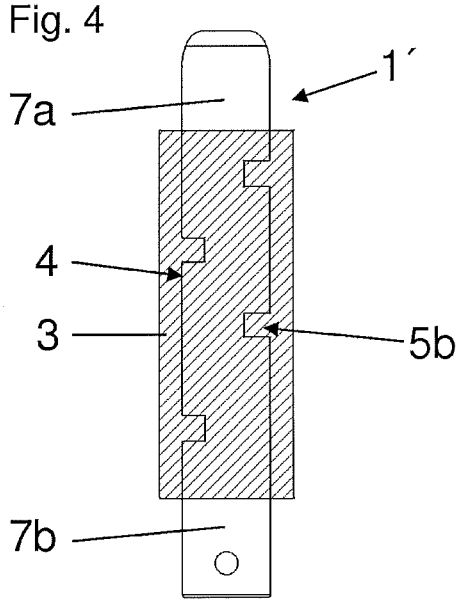
FIG. 4 illustrates a planar view of a flat contact having an extrusion coated intermediate region and non-extrusion coated end sections with the intermediate region having rectangular shaped recesses or cavities in accordance with an embodiment of the present invention.

Referring now to FIG. 4, with continual reference to FIG. 3, a planar view of a flat contact 1' in accordance with another embodiment of the present invention is shown. Again, the hatched area schematically shows extrusion coating 3 for a partial volume of plastic body 2 that directly encloses intermediate region 4 of flat contact 1'. As a result, intermediate region 4 is an extrusion coated (or encapsulated) intermediate region of flat contact 1' and end sections 7*a*, 7*b* of flat contact 1' are non-extrusion coated (or non-encapsulated) end sections of flat contact 1'.

In comparison with flat contact 1 as shown in FIG. 3, intermediate region 4 of flat contact 1' includes rectangular shaped recesses or cavities 5*b*. Rectangular shaped recesses 5*b* are formed in the longitudinal sides of flat contact 1' at various locations along the axial direction (length) of flat contact 1'. Again, extrusion coating 3 makes a bond in a form fitting manner with recesses 5*b*. The bond is fluid-tight over a broad temperature and pressure region due to the "non-shrinking" properties of the duroplastic material that is used for extrusion coating 3.

Non-extrusion coated end sections 7*a*, 7*b* of flat contacts 1 and 1' can still be galvanically treated after the extrusion process. For example, it is possible to improve the electrical conductivity properties with a coating of silver.

Figure 5:
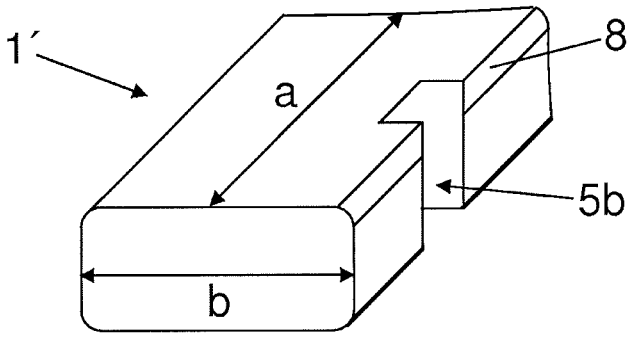
FIG. 5 illustrates a perspective cross-sectional view of a segment of the intermediate region of the flat contact shown in FIG. 4.

Referring now to FIG. 5, with continual reference to FIG. 4, a perspective cross-sectional view of a segment of intermediate region 4 of flat contact 1' is shown. One of rectangular shaped recesses 5*b* is shown in FIG. 5. As further shown in FIG. 5, the cross-sectional width "b" of flat contact 1' varies in its axial direction "a" through rectangular shaped recess 5*b*.

In accordance with embodiments of the present invention, longitudinal edges 8 extending in the axial direction "a" of flat contact 1' are rounded. Rounded longitudinal edges 8 of flat contact 1' are molded by embossing flat contact 1' on the side to be stamped on the raw edge. Rounded longitudinal edges 8 of flat contact 1' shown in FIG. 4 or flat contact 1 shown in FIG. 3 significantly improve the bonding of flat contact 1' to extrusion coating 3.

REFERENCE SYMBOLS

1,1' flat contact
2 plastic body
3 extrusion coating
4 intermediate region of flat contact
5*a* (rounded) recesses of intermediate region of flat contact
5*b* (rectangular) recesses of intermediate region of flat contact
6 plug-in connector housing
7*a*, 7*b* end sections of flat contact
8 longitudinal edges of flat contact
9, 10 chambers
a axial direction of flat contact
b cross-section width of flat contact While exemplary embodiments are described above, it is not intended that these embodiments describe all possible forms of the present invention. Rather, the words used in the specification are words of description rather than limitation, and it is understood that various changes may be made without departing from the spirit and scope of the present invention. Additionally, the features of various implementing embodiments may be combined to form further embodiments of the present invention.

What is claimed is:

1. A fluid-tight contact implementation comprising:
a plastic body, wherein the plastic of the plastic body is composed of a non-shrinking, duroplastic material;
a flat contact having a region encapsulated by the plastic body, the region of the flat contact having a cross-sectional width which varies along an axial direction of the flat contact, wherein longitudinal edges of the region of the flat contact along the axial direction are rounded;
the flat contact includes end sections at opposite ends of the region of the flat contact, wherein the end sections are not encapsulated by the plastic body; and
the region of the flat contact includes recesses which vary the cross-sectional width of the region along the axial direction of the flat contact without varying a cross-sectional height of the region along the axial direction of the flat contact.

2. The contact implementation of claim 1 wherein:
the recesses are rounded.

3. The contact implementation of claim 1 wherein:
the recesses are rectangular shaped.

4. The contact implementation of claim 1 wherein:
the plastic body and the flat contact have at least similar thermal expansion coefficients.

5. The contact implementation of claim 1 further comprising:
a bonding agent between plastic body and the region of the flat contact.

6. The contact implementation of claim 1 wherein:
the plastic body forms a plug-in connector housing.

7. The contact implementation of claim 1 further comprising:
a plurality of other flat contacts, each of these flat contacts having a region encapsulated by the plastic body, the region of each of these flat contacts having a cross-sectional width which varies along an axial direction of these flat contacts, wherein longitudinal edges of the region of each of these flat contacts along the axial direction are rounded.

8. The contact implementation of claim 1 wherein:
the non-encapsulated end sections of the flat contact are treated by a galvanic process and the encapsulated region of the flat contact is not treated by the galvanic process.

9. The contact implementation of claim 1 wherein:
the non-encapsulated end sections of the flat contact include at least one of a tin and silver coating and the encapsulated region of the flat contact does not include either a tin or silver coating.

10. The contact implementation of claim 1 wherein:
the longitudinal edges of the flat contact are embossed in a stamping process and thereby rounded circumferentially.

11. The contact implementation of claim 1 wherein:
the non-shrinking, duroplastic material includes an epoxy resin, a phenol resin, or a bulk molding compound with non-shrinking properties.

12. The contact implementation of claim 1 wherein:

the rounded longitudinal edges respectively form rounded corners of the region of the flat contact.

13. A fluid-tight contact implementation comprising:

a plastic body, wherein the plastic of the plastic body is composed of a non-shrinking, duroplastic material;

a flat contact having a region encapsulated by the plastic body, the encapsulated region of the flat contact having longitudinally extending side surfaces with rounded corners and a laterally varying cross-sectional width;

the flat contact includes end sections at opposite ends of the encapsulated region of the flat contact, wherein the end sections are not encapsulated by the plastic body; and the encapsulated region of the flat contact includes recesses which laterally vary the cross-sectional width of the encapsulated region without varying a cross-sectional height of the encapsulated region.

14. The contact implementation of claim 13 wherein:

the recesses of the encapsulated region of the flat contact are either rounded or rectangular shaped.

15. The contact implementation of claim 13 wherein:

the rounded corners of the longitudinally extending side surfaces are embossed in a stamping process and thereby rounded circumferentially.

16. The contact implementation of claim 13 wherein:

the non-shrinking, duroplastic material includes an epoxy resin, a phenol resin, or a bulk molding compound with non-shrinking properties.

17. A fluid tight contact implementation comprising:

a plastic body, wherein the plastic of the plastic body is composed of a non-shrinking, duroplastic material;

a flat contact having a region encapsulated by the plastic body, the flat contact having rounded corners extending longitudinally along a length of the flat contact and recesses positioned along a length of the encapsulated region of the flat contact;

the flat contact further includes end sections at opposite ends of the encapsulated region of the flat contact, wherein the end sections are not encapsulated by the plastic body; and the recesses positioned along the length of the encapsulated region of the flat contact vary a cross-sectional width of the encapsulated region along the length of the encapsulated region without varying a cross-sectional height of the encapsulated region along the length of the encapsulated region.

18. The contact implementation of claim 17 wherein:

the non-shrinking, duroplastic material includes an epoxy resin, a phenol resin, or a bulk molding compound with non-shrinking properties.

19. The contact implementation of claim 17 wherein:

the recesses of the encapsulated region of the flat contact are either rounded or rectangular shaped recesses.

* * * * *